US005890716A

United States Patent [19]

Bofinger et al.

[11] Patent Number: 5,890,716

[45] Date of Patent: Apr. 6, 1999

[54] DICE LIKE TOY

[75] Inventors: Joachim Bofinger, Renningen; Wolfgang Geisler, Sidelfingen; Manfrd Springer, Calw-Altburg, all of Germany

[73] Assignee: Dieter Holzle Technik-Projetke GmbH, Deckenpfronn, Germany

[21] Appl. No.: 979,958

[22] Filed: Nov. 26, 1997

[30] Foreign Application Priority Data

Nov. 28, 1996 [DE] Germany ..... 196 49 297.1

[51] Int. Cl.[6] ..... A63F 9/04

[52] U.S. Cl. ..... 273/146

[58] Field of Search ..... 273/146

[56] References Cited

U.S. PATENT DOCUMENTS

| | | | |
|---|---|---|---|
| 1,563,680 | 12/1925 | Zwirner | 273/146 |
| 4,030,210 | 6/1977 | Stebbins et al. | 273/146 |
| 4,465,279 | 8/1984 | Larson | 273/146 |

FOREIGN PATENT DOCUMENTS

| | | | |
|---|---|---|---|
| 1133997 | 4/1957 | France | 273/146 |
| 1230474 | 9/1960 | France | 273/146 |
| 3603162 A1 | 8/1987 | Germany . | |
| 3641730 A1 | 6/1988 | Germany . | |
| 196 49 297 C1 | 10/1997 | Germany . | |

*Primary Examiner*—Benjamin H. Layno
*Attorney, Agent, or Firm*—Pillsbury Madison & Sutro

[57] ABSTRACT

A dice-like toy composed of a polygonal body with main surfaces located in pairs opposite each other, which are respectively used as resting surfaces and as display surfaces. The main surfaces are arranged on the body in such a way that the axis of symmetry of oppositely located resting and display surfaces are inclined relative to each other. This results in a shape of the toy which, in contrast to conventional dice, no longer generates an essentially straight-line throw, but causes more direct and more abrupt directional changes in the course of progress because of increasingly occurring edges. In this connection, elliptical surfaces are particularly preferred as the main game surfaces, wherein the two elliptical main axes of oppositely located main surfaces extend perpendicularly to each other.

14 Claims, 3 Drawing Sheets

DICE LIKE TOY

BACKGROUND OF THE INVENTION

The invention relates to the field of toys and amusement devices, and in particular dice-like toys or game pieces which remain in a position at the end of a defined movement progression, wherein an indicator surface, which as a rule points upward, indicates a defined result or a defined symbol, from whose value it is possible to determine, for example, the progress of a game, but which can also be used without any other accessories for game and entertainment purposes.

A game of this type is disclosed in German Patent Publication DE 36 03 162 A1. This game includes throwing dice which differ from traditional dice only in that, in place of the six square lateral surfaces, six diamond-shaped lateral surfaces are provided, it being intended to give at least the impression that it is possible to achieve a desired result in a preferred manner by means of a certain behavior of the dice. In this case, the lateral surfaces constituting mutually opposed resting and indication surfaces are offset with respect to each other.

U.S. Pat. No. 4,465,279 provides a pentagonal dodecahedron put together from two halves, whose total of twelve resting and display surfaces are respectively embodied as pentagons. Oppositely located pentagons have the same display symbols (for example the same number). The goal of this construction is a statistically absolutely equal probability of the appearance of all display symbols. The "throwing characteristics" are relatively straight because of the large number of surfaces.

German Patent Publication DE 36 41 730 A1 discloses a similar toy, which is constituted by a polygon with a large number of main surfaces connected with each other by beveled edges, so that this polygon comes even closer to a sphere-like shape. In contrast to the subject of the first mentioned reference, it is intended here to make manipulation impossible because of the high degree of symmetry of the individual surfaces of the polygon and the sphere-like shape. The object of this reference also is to provide a multitude of surfaces, but to avoid surfaces of different size. This embodiment of the known object makes ball-like games possible, in particular when using appropriately large embodiments, and would therefore be classified as a toy which lies in a transition area between dice and a ball.

BRIEF SUMMARY OF THE INVENTION

It is an object of the present invention, in contrast to the known dice-like toys, to provide a toy whose movements are more surprising, in particular when used in accordance with its intent, without causing a preference for at least the main game surfaces in the course of the game, this being achieved, for example, by giving the toy an appropriate symmetry.

The above and other objects are attained, in accordance with the invention by a dice-like toy, composed of a polygonal body with a plurality of oval, egg-shaped or elliptical flat main surfaces, each of the main surfaces having a respective major axis, the main surfaces being arranged in pairs, the main surfaces of each pair being disposed opposite one another, at least one of the main surfaces is provided with at least one visible symbol, and each of the main surfaces is positionable as a downwardly facing resting surface or an upwardly facing display surface, and the toy having at least one axis of symmetry extending along a major axis of one of the main surfaces, wherein the main surfaces are oriented on the body in such a way that the major axes of the two main surfaces of each pair are skewed relative to one another.

Therefore the basic concept for the attainment of objects according to the invention is that by means of the inclination of corresponding axes of symmetry of oppositely located oval main surfaces, in particular if they extend perpendicularly to each other, no essentially straight-line toss will take place, such as with conventional dice, but instead a surprising movement pattern is generated by means of the tilting, which increasingly occurs in the course of movement, in the sense that more direct and abrupt directional changes occur, which make the total movement of the toy less predictable and therefore more surprising.

A particularly preferred embodiment provides that the oval main game surfaces are ellipses, which are essentially generated as planes of section, wherein the two main axes of the ellipses of oppositely located main surfaces extend perpendicularly to each other. This arrangement creates free spaces in the transition or corner areas of the body of the toy between the elliptical planes of section which, in accordance with another embodiment, also are flattened, are located next to each other in a spatial diagonal line of the body and can also constitute resting or display surfaces. By means of an appropriate design of the resting surface or respectively of the ratio of the resting surfaces of the main surfaces to the side surfaces, it is therefore possible to form two classes of resultant surfaces, to which different meanings can be assigned, depending on the type of game. For example, side surfaces which are made considerably smaller can be used as joker surfaces, i.e., surfaces by means of which, when they occur, i.e., when the body comes to rest on such a small surface, a defined game content or continuation of the game is made possible for the person throwing the dice at that time which otherwise, with a "regular" result, i.e., main surfaces as resting surfaces, could not have been done.

Appropriate symbols, which can be game symbols or advertising symbols, depending on the intended use of the toy, for example as advertising articles, are preferably located on the main surfaces and at least on a part of the side surfaces mentioned.

According to a further, particularly preferred, embodiment of the toy, these symbols, which represent the idea of the respective game, are especially set off inside of the main surfaces and/or the side surfaces from their surroundings by being colored differently or consisting of different materials, wherein this can be done in a technically simple and esthetically very satisfying manner; in particular the toy may consist, on the one hand, of a separately manufactured core and, on the other hand, of at least one partial shell, wherein the core and the shell have corresponding protrusions and recesses engaging each other, which represent the respective symbols. For example, by using differently colored plastic materials, it is possible here in a very simple production manner to generate a lively total impression of the toy.

A preferred embodiment of the dice-like toy in accordance with the invention will now be described in more detail with reference to the attached drawings.

DETAILED DESCRIPTION OF THE INVENTION

FIGS. 1 and 2 represent two perspective views of the preferred exemplary embodiment of the toy from two different viewing directions. FIGS. 1A and 2A show perspective representations, wherein the perspective representation of FIG. 2A results from rotating the perspective representation of FIG. 1A around the axis R—R in FIG. 1A by 90°. In FIG. 1A the direction of view is obliquely from above in the direction of the minor axis of the elliptical main surface 11, in FIG. 2A the direction of view is obliquely from above, at a different viewing angle, in the direction toward the major axis of the elliptical main surface 11.

Figure 1A:
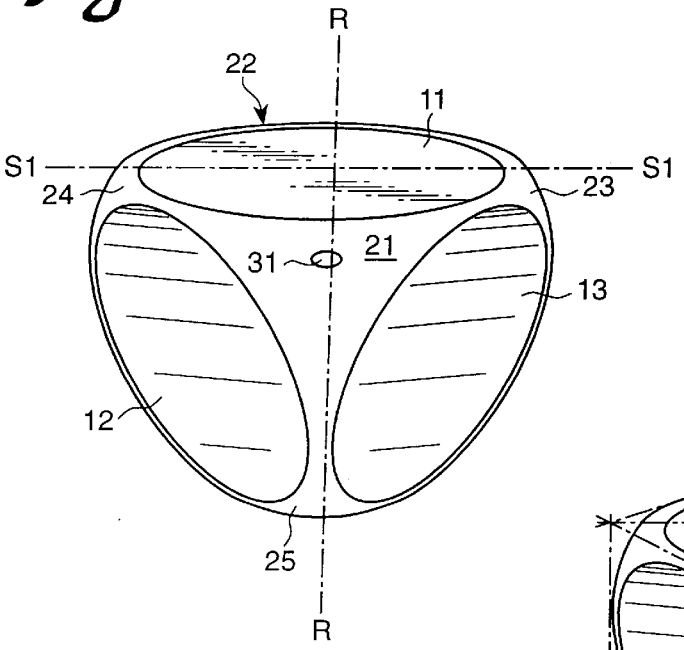
FIGS. 1A to 1D show perspective views from a first viewing direction of a preferred embodiment of the toy in differently drawn representations.
Figure 1B:
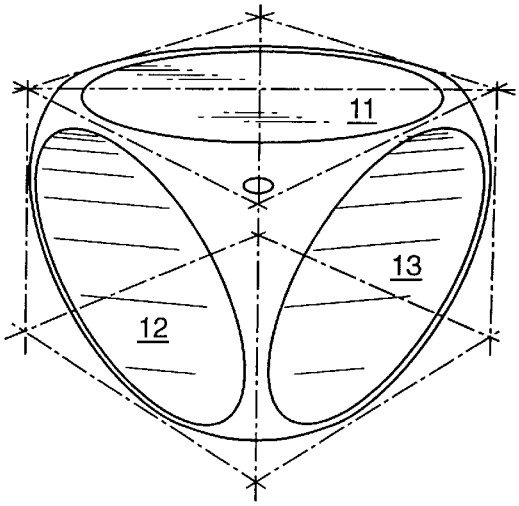
Figure 2A:
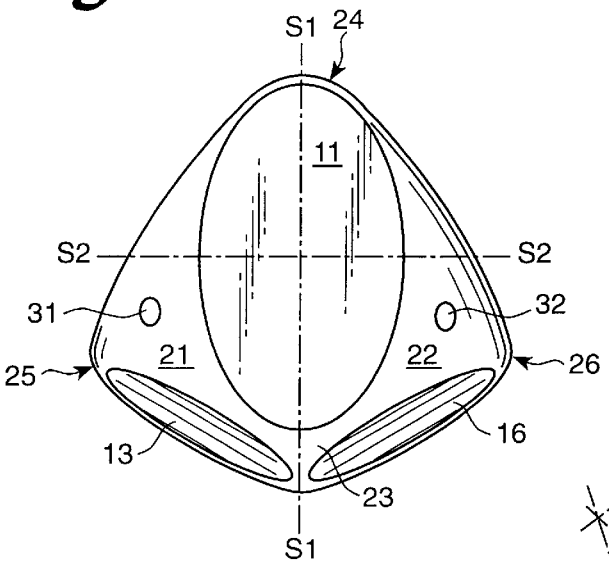
FIGS. 2A to 2D show a perspective view from a second viewing direction, rotated by 90° in respect to the first view, also in differently drawn representations.
Figure 2B:
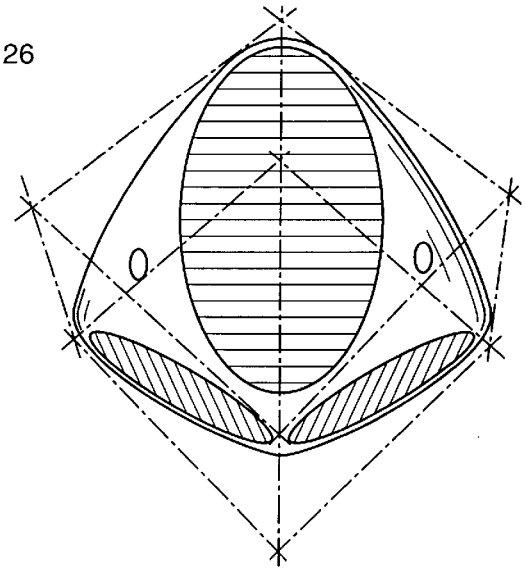

FIGS. 1B and 2B show corresponding perspective views with the addition of a prismatic die, drawn in of dash-dotted lines, as an enveloping structure. It becomes clear from these representations that the main surfaces of the toy visible in these representations can be formally represented as elliptical planes of section of a spherical body with the side surfaces of this enveloping die, wherein the axes of the ellipsis respectively extend in the direction of the diagonal line of the associated die surface.

Figure 1C:
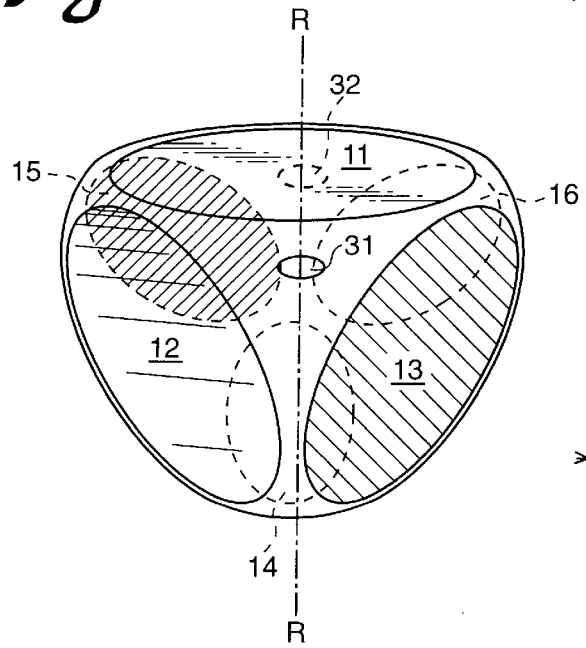
Figure 2C:
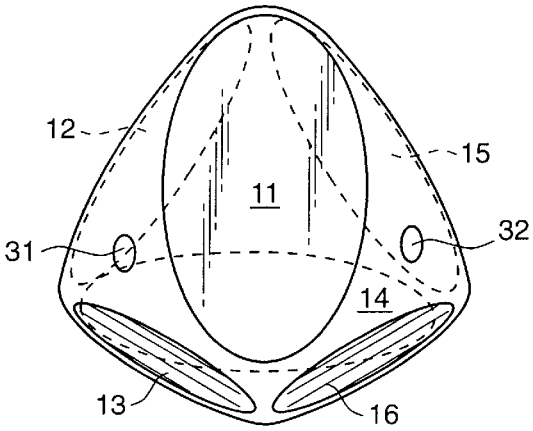

FIGS. 1C and 2C correspond in their representation to FIGS. 1A and 2A wherein, however, of the six main surfaces 11 to 16, the three rear main surfaces that are not visible are drawn in dashed lines. These representation makes it particularly clear that the main axes of oppositely located main surfaces extending parallel in respect to each other, corresponding to the oppositely located side surfaces of the enveloping die in FIGS. 1B and 2B, extend perpendicularly in respect to each other, such as is intended to be made clear by appropriate cross-hatching in the example of the oppositely located main surfaces 13 and 15 in FIG. 1C.

Figure 1D:
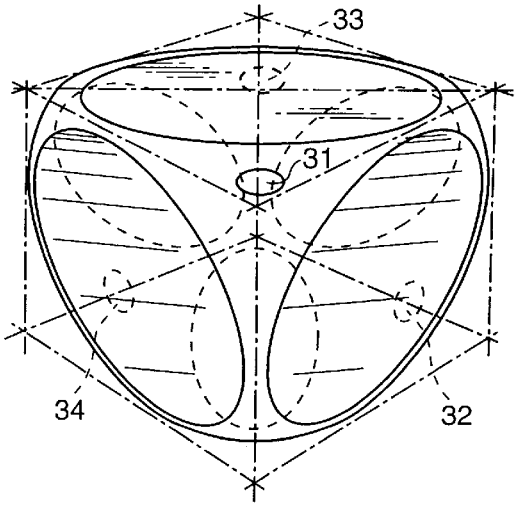
Figure 2D:
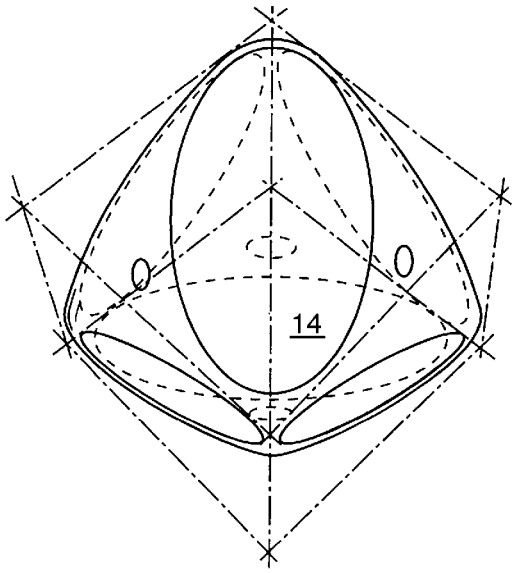

Finally, FIGS. 1D and 2D represent a combination of the previous FIGS. 1B and 1C or respectively FIGS. 2B and 2C. The association of oppositely located main surfaces in particular becomes clear from these representations, too, which, on the one hand, extend in planes which are parallel with each other in accordance with the oppositely located side surfaces of the enveloping die, but on the other hand are rotated by 90° in respect to each other in this plane. Although FIGS. 2B and 2D are not provided with reference numerals, each element can be identified by direct comparison with the essentially identical views of FIGS. 2A and 2C.

The total representations of FIGS. 1 and 2 also illustrate transition, or corner, areas between the elliptical main surfaces 11 to 16, four of which, such as transition areas 21 and 22 in FIG. 1A, for example, are embodied as relatively large-surfaced, rounded corner areas between the "longitudinal sides" of adjoining elliptical main surfaces, e.g., corner area 21 is located between main surfaces 11, 12 and 13, while four other corner areas, including corner areas 23, 24 and 25 in FIG. 1A, are made with much smaller surfaces at the spot where the "tips" of main surfaces are proximate to one another.

Additional flattenings are provided on the larger four corner areas, which flattenings form side surfaces 31 to 34, which can be used as additional playing surfaces, i.e., resting surfaces and display surfaces. Because of the geometric design, two of such side surfaces are placed opposite one another in the spatial diagonal of the die body.

Figure 3:
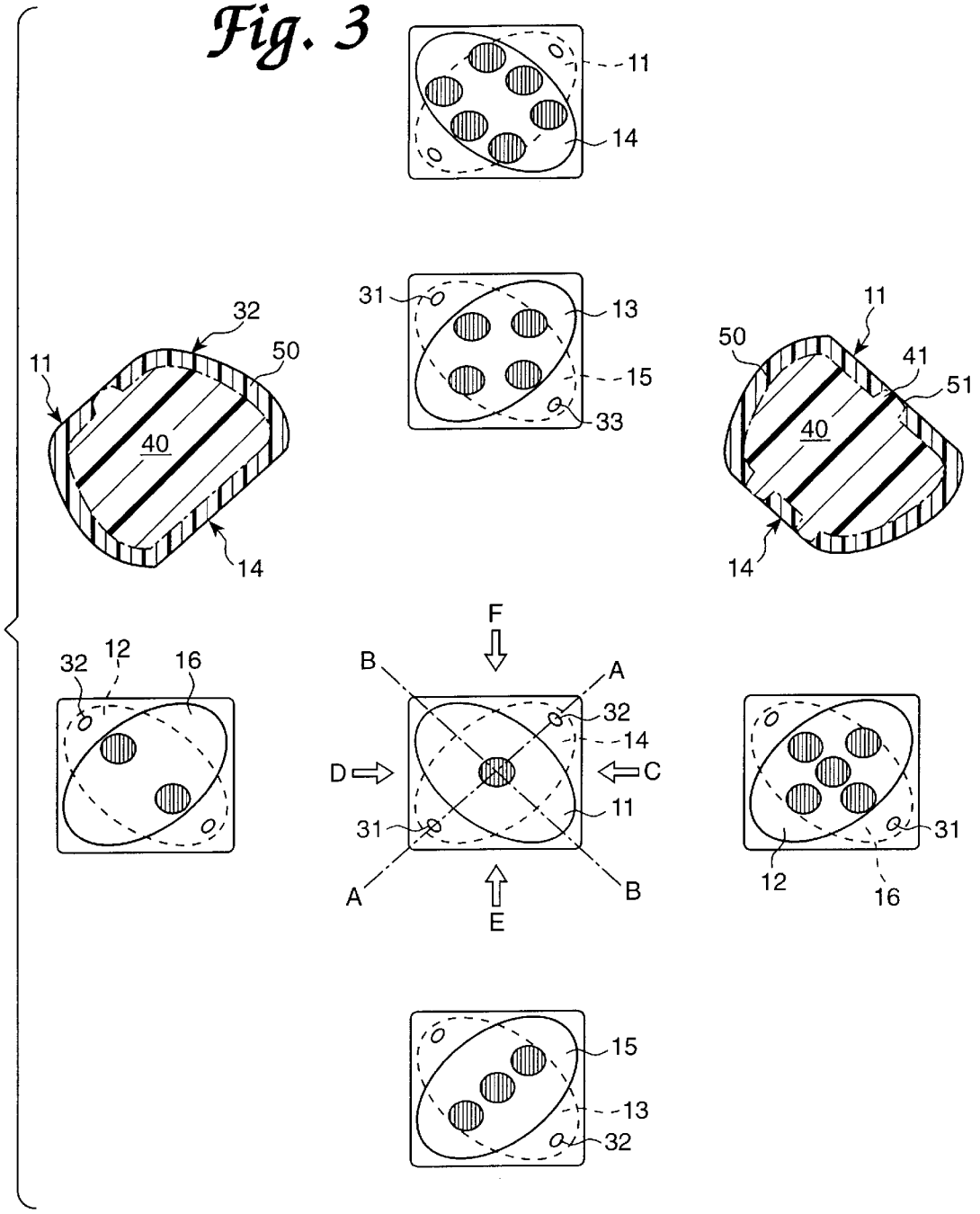
FIG. 3 shows views on the six side surfaces of the toy, and two vertical sections.

For reasons of clarity of the representation, no symbols have been drawn on the main surfaces 11 to 16 in FIGS. 1 and 2. They are represented in FIG. 3, which consists of four elevational views, a top plan view, a bottom plan view and two cross-sectional views. Die spots have been placed on the main surfaces 11 to 16 as the conventional symbols on dice. The two cross-sectional views of FIG. 3 are taken along planes A—A and B—B, respectively, from which the preferred embodiment of a practical structural realization of the toy in accordance with the invention can be seen. The toy is made of a core 40 and a shell 50 enclosing this core 40. Core 40 can be produced, for example, as a pre-injection-molded part and shell 50 as a finished injection-molded part in a multi-stage injection molding process.

In this connection a special embodiment provides that the spots represented in cross-hatching in the elevational and views of FIG. 3 are constituted by protrusions 41 of core 40. Protrusions 41 engage corresponding recesses 51 in the shell 50, so that different possibilities result from this for a color design as well as differing surface designs of the surface of the spots on the one hand, and the remaining surface of the toy on the other hand.

Figure 4:
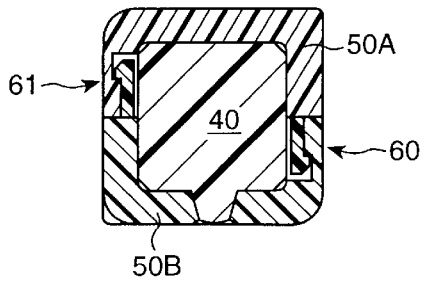
FIG. 4 is a principal cross-sectional view through an embodiment of the toy consisting of a core and two half-shells essentially of the same shape.

Finally, a variant of this technical realization is shown by the cross-sectional representation of FIG. 4, in a plane parallel to a side surface of the toy, wherein a core 40 and two partial shells 50A, 50B are separately produced and the two partial shells are then locked together by means of detent elements 60, 61, which have detent tongues which engage appropriately corresponding undercuts of the respective opposite element.

This application relates to subject matter disclosed in German Application Number 196 49 297.1, filed on Nov. 28, 1996, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A dice-like toy comprising a polygonal body with a plurality of oval, egg-shaped or elliptical flat main surfaces (11 to 16), each of said main surfaces having a respective major axis, said main surfaces being arranged in pairs, said main surfaces of each said pair being disposed opposite one another, at least one of said main surfaces is provided with at least one visible symbol, and each of said main surfaces is positionable as a downwardly facing resting surface or an upwardly facing display surface, and said toy having at least one axis of symmetry (S1) extending along a major axis of one of said main surfaces, wherein said main surfaces (11 to 16) are oriented on said body in such a way that the major axes of the two main surfaces of each said pair are skewed relative to one another.

2. The dice-like toy in accordance with claim 1, wherein the major axes of the two main surfaces of each said pair lie in mutually perpendicular planes.

3. The dice-like toy in accordance with claim 1, wherein the main surfaces are ellipses, each having a minor axis and the minor axis and major axis of each of said ellipses have a length ration of approximately 2:3 to 1:3.

4. The dice-like toy in accordance with claim 1, further comprising transition areas between said main surfaces (11 to 16), said transition areas being formed to give said body a shape of a cubic die with eight beveled corner areas (21 to 28).

5. The dice-like toy in accordance with claim 4, wherein at least four of said corner areas are flattened and respectively form flattened side surfaces (31 to 34) each located opposite another one of said side surfaces in a spatial diagonal line of the body, each of said side being positionable to constitute a downwardly facing resting surface.

6. The dice-like toy in accordance with claim 5, wherein each of said side surfaces (31 to 34) is provided with at least one visible symbol and is positionable to constitute an upwardly facing display surface.

7. The dice-like toy in accordance with claim 1, wherein each main surface lies in a respective plane and the at least one visible symbol provided at said at least one of the main surfaces protrudes out of the plane of that main surface.

8. The dice-like toy in accordance with claim 7, wherein the at least one visible symbol provided at said at least one of the main surfaces is profiled in respect to that main surface.

9. The dice-like toy in accordance with claim 7, wherein the surface structure of the at least one visible symbol is different from the surface structure of the at least one of the main surfaces on which the at least one visible symbol is provided.

10. The dice-like toy in accordance with claim 1, wherein said body comprises a core (40) of a first material and at least one outer shell (50, 50A, 50B) of a second material different from said first material.

11. The dice-like toy in accordance with claim 10, wherein said core (40) has at least one protrusion (41) which engages a recess (51) cut into a depression in said outer shell (50, 50A, 50B) and at least a portion of the at least one protrusion is visible from the outside.

12. A method for producing the toy in accordance with claim 10 comprising:

forming the core (40) by a pre-injection-molding process; and forming the shell (50) around the core as a finished injection-molded part in an injection molding process subsequent to the pre-injection-molding process.

13. A method for producing a toy in accordance with claim 10, comprising:

producing said core and wherein the core (40) and at least two partial shells (50A, 50B) separately; and connecting the partial shells to the core by means of detent elements (60, 61).

14. The dice-like toy in accordance with claim 1 wherein each main surface lies in a respective plane and the at least one visible symbol provided at said at least one of the main surfaces protrudes out of the plane of that main surface said core (40) has at least one protrusion (41) which engages a recess (51) cut into a depression in said outer shell (50, 50A, 50B) and at least a 10 portion of the at least one protrusion is visible from the outside and the visible portions of the protrusion(41) of the core (40) constitutes the at least one visible symbol.

* * * * *